US007513392B2

(12) United States Patent
Fowler et al.

(10) Patent No.: US 7,513,392 B2
(45) Date of Patent: Apr. 7, 2009

(54) FLUID CAPTURE APPARATUS

(76) Inventors: Janice K. Fowler, 2321 Brewster Rd., Holdrege, NE (US) 68949; Bonnie Young, 2321 Brewster Rd., Holdrege, NE (US) 68949

( * ) Notice: Subject to any disclaimer, the term of this patent is extended or adjusted under 35 U.S.C. 154(b) by 722 days.

(21) Appl. No.: 11/101,306

(22) Filed: Apr. 7, 2005

(65) Prior Publication Data

US 2006/0226172 A1 Oct. 12, 2006

(51) Int. Cl.

| | |
|---|---|
| ***B65D 5/72*** | (2006.01) |
| ***B67D 1/16*** | (2006.01) |
| ***B65B 1/04*** | (2006.01) |
| ***D06F 39/08*** | (2006.01) |

(52) U.S. Cl. ..... 222/108; 222/573; 141/86; 137/312

(58) Field of Classification Search ..... 222/108, 222/573, 571; 141/86, 88; 137/312
See application file for complete search history.

(56) References Cited

U.S. PATENT DOCUMENTS 5,470,011 A * 11/1995 Jordan ..... 222/108
D401,111 S * 11/1998 Leatherman ..... D7/397
6,279,781 B1 * 8/2001 Konar ..... 222/108
6,289,946 B1 * 9/2001 Davies ..... 141/86
7,216,778 B2 * 5/2007 Kaeb ..... 222/108

* cited by examiner

*Primary Examiner*—Kevin P Shaver
*Assistant Examiner*—Melvin A Cartagena
(74) *Attorney, Agent, or Firm*—Stanton Collier

(57) ABSTRACT

A fluid capture apparatus comprises a fluid-receiving body, a drain member, a generally flat support body and a fluid-channeling extension body. The fluid-receiving body has an open end and a bottom end. A fluid reservoir is defined between the open end and the bottom end. The drain member is attached to the fluid receiving body and communicative with the fluid reservoir for enabling fluid within the fluid reservoir to pass through the drain member. The fluid-channeling extension body has a first end thereof attached to the support body and a second end thereof attached to the fluid-receiving body. The fluid-channeling extension body includes a front face and spaced apart fluid guide members. The spaced apart fluid guide members protrude above the front face and extend at least partially between the support body and the fluid-receiving body thereby providing means for channeling fluid into the fluid reservoir of the fluid-receiving body.

1 Claim, 3 Drawing Sheets

FLUID CAPTURE APPARATUS

FIELD OF THE DISCLOSURE

The disclosures made herein relate generally to beverage dispensers and, more particularly, to fluid capture apparatuses for beverage dispensers.

BACKGROUND

Beverage containers with a selectable dispensing device are well known (i.e., conventional dispensing beverage containers). An insulated container having a spigot communicating with a beverage cavity of the container is one example of such a conventional dispensing beverage container. The spigot is an example of a beverage flow control device.

In the case of an insulated container with a spigot, the container is positioned on a support surface (e.g., a table) with the spigot orientated to permit dispensing of beverage into a use container (e.g., a cup) positioned under the spigot. In one instance, the container is positioned above a surface of the table on a stand. In another instance, the container is positioned at the edge of the table with the spigot positioned over the floor. A beverage contained within the beverage cavity is selectively dispensable through the spigot in response to a person moving a control portion of the spigot from a position that inhibits the flow of beverage therethrough (i.e., a closed position) to a position that enables the flow of beverage therethrough (i.e., an open position). Typically, the spigot is biased to the closed position.

One drawback of a flow control devices used on conventional dispensing beverage containers is that they tend to drip. In some instances, they do not seal fully and drip so long as a sufficient level of beverage is contained within the beverage cavity of the container. In other instances, a small residual amount of beverage remaining in the flow control device drips after a control portion of the flow control device is returned to its closed position. In yet another instance, a user simply removed their cup from under the flow control device prior to the flow control device being returned to the closed position, thus causing a spill.

Regardless of the reason, such dripping and/or spilling is undesirable as it creates a mess and/or a potentially dangerous situation. Stains on a tablecloth look unsightly and stains on the floor can lead to a person slipping and falling. Therefore, an apparatus that overcomes drawbacks associated with dripping/spilling of beverage from a flow control device of a conventional dispensing beverage container would be useful, advantageous and novel.

SUMMARY OF THE DISCLOSURE

Embodiments of the present invention address the problem of fluid that drips and spills from a flow control device of a beverage container. More specifically, embodiments of the present invention provide a means for capturing fluid that drips and spills from a flow control device of a beverage container. In doing so, embodiment of the present invention advantageously overcome drawbacks associated with dripping/spilling of beverage from a flow control device of a conventional dispensing beverage container.

In one embodiment of the present invention, a fluid capture apparatus comprises a fluid-receiving body, a support body and an extension body. The fluid-receiving body has an open end and a bottom end. The fluid reservoir is defined between the open end and the bottom end. The extension body has a first end thereof attached to the fluid-receiving body and a second end thereof attached to the support body. The extension body extends in a manner such that the support body is vertically offset from the fluid receiving body when the fluid-receiving body is in a use-orientation.

In another embodiment of the present invention, a fluid capture apparatus comprises a fluid-receiving body, a drain member and an extension body. The fluid-receiving body has an open end and a bottom end. The fluid reservoir is defined between the open end and the bottom end. The drain member is attached to the fluid-receiving body and communicative with the fluid reservoir for enabling fluid within the fluid reservoir to pass through the drain member. The extension body has a first end and a second end. The second end of the extension body is attached to the fluid-receiving body.

In another embodiment of the present invention, a fluid capture apparatus comprises a fluid-receiving body, a generally flat support body and a fluid-channeling extension body. The fluid-receiving body has an open end and a bottom end. A fluid reservoir is defined between the open end and the bottom end. The fluid-channeling extension body has a first end thereof attached to the support body and a second end thereof attached to the fluid-receiving body. The fluid-channeling extension body includes a front face and spaced apart fluid guide members. The spaced apart fluid guide members protrude above the front face and extend at least partially between the support body and the fluid-receiving body thereby providing means for channeling fluid into the fluid reservoir of the fluid-receiving body.

Turning now to specific aspects of the present invention, in at least one embodiment, a fluid passage of the drain member extends through a floor of the fluid-receiving body.

In at least one embodiment of the present invention, the drain member includes a nipple suitably configured for having a drain conduit attached thereto for being in fluid communication with the fluid passage.

In at least one embodiment of the present invention, the extension body includes a front face, the support body includes generally flat opposed faces and the front face of the extension body is skewed relative to the opposed faces of the support body.

In at least one embodiment of the present invention, a drain member is attached to the fluid-receiving body and is communicative with the fluid reservoir for enabling fluid within the fluid reservoir to pass through the drain member.

In at least one embodiment of the present invention, the extension body extends in a manner such that the support body is horizontally offset from the fluid receiving body when the fluid-receiving body is in the use-orientation.

In at least one embodiment of the present invention, the extension body includes a front face and spaced apart fluid guide members and the spaced apart fluid guide members protrude above the front face and extend at least partially between the support body and the fluid-receiving body thereby providing means for channeling fluid into the fluid reservoir of the fluid-receiving body.

These and other objects, embodiments advantages and/or distinctions of the present invention will become readily apparent upon further review of the following specification and associated drawings.

DETAILED DESCRIPTION OF THE DRAWING FIGURES

Figure 1:
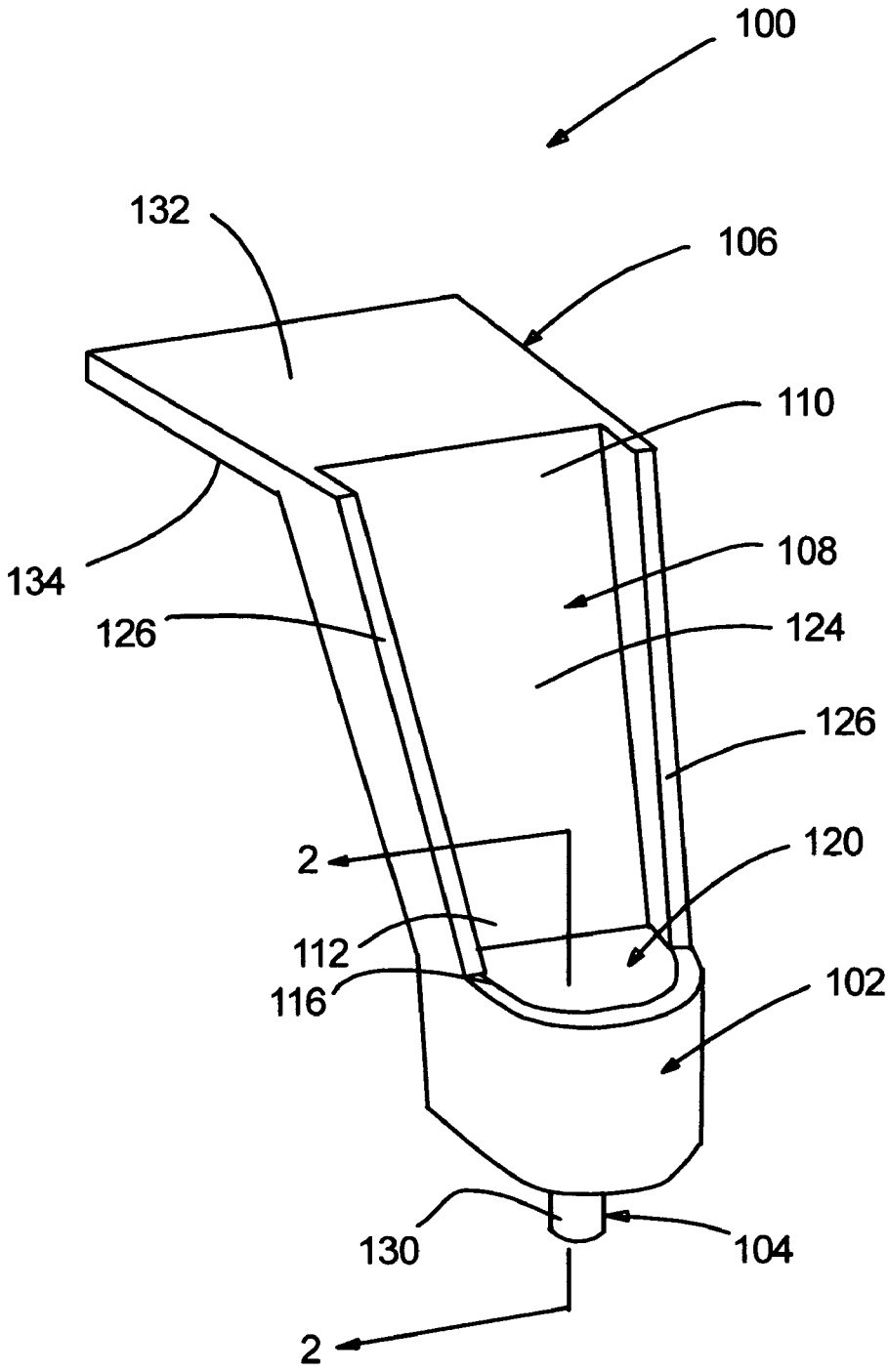
FIG. 1 depicts a fluid capture apparatus in accordance with an embodiment of the inventive disclosures made herein.
Figure 2:
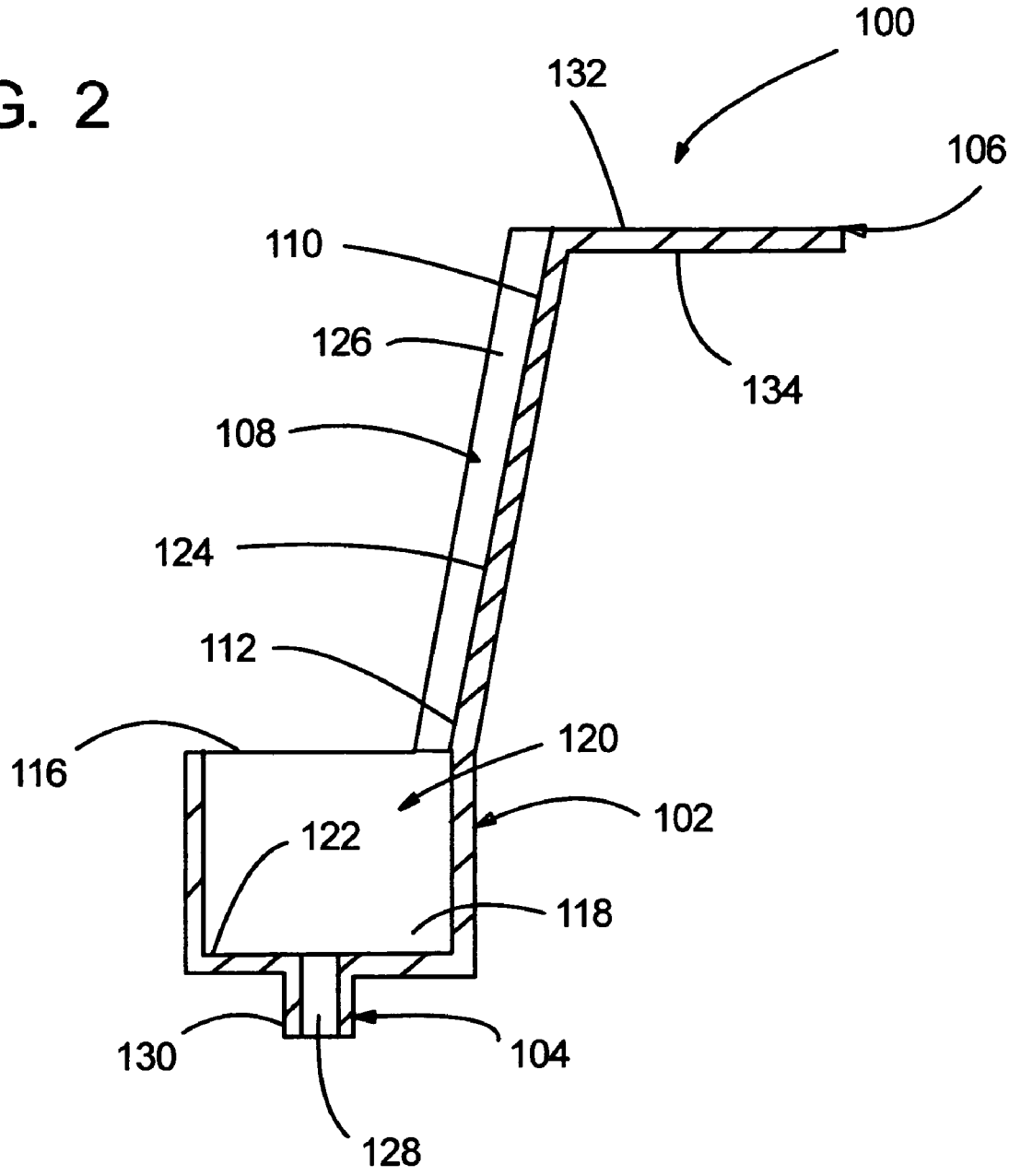
FIG. 2 is a cross sectional view taken along the line 2-2 in FIG. 1.
Figure 3:
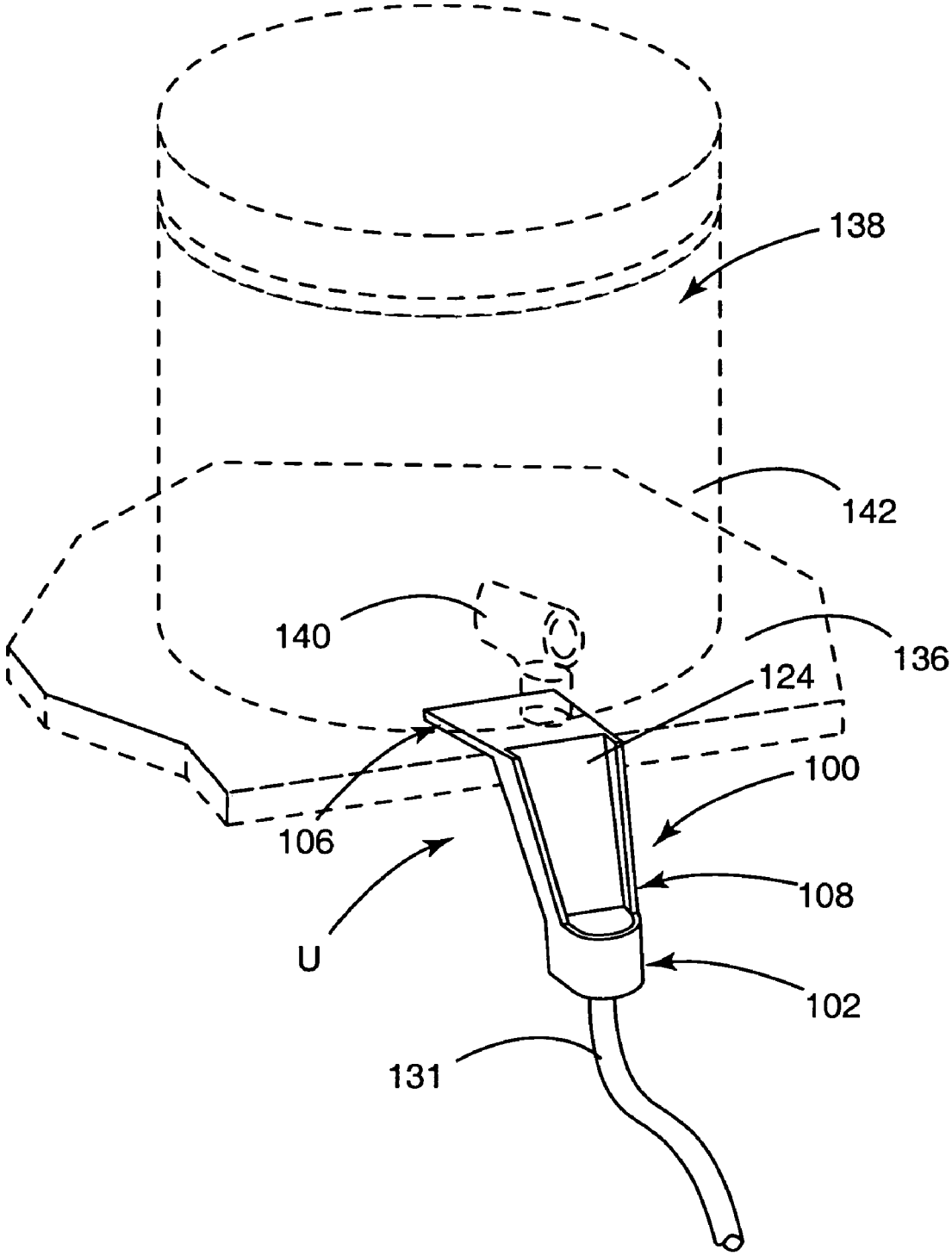
FIG. 3 is a perspective view depicting the fluid capture apparatus of FIG. 1 in a use orientation.

FIGS. 1-3 depict an embodiment of a fluid capture apparatus (generally referred to as fluid capture apparatus 100) in accordance with the present invention. The fluid capture apparatus 100 includes a fluid-receiving body 102, a drain member 104, a support body 106 and an extension body 108. The extension body 108 has a first end 110 thereof attached to the support body 106 and a second end 112 thereof attached to the fluid-receiving body 102.

The fluid-receiving body 102 has an open end 116 and a bottom end 118. A fluid reservoir 120 is defined between the open end 116 and the bottom end 118. As depicted, a floor 122 at the bottom end 118 of the fluid-receiving body 102 is generally flat. Optionally, the floor 122 may have a non-flat profile, such as being tapered or concave.

The extension body 108 includes a front face 124 and spaced apart fluid guide members 126. The spaced apart fluid guide members 126 protrude above the front face 124 and extend at least partially between the support body 106 and the fluid-receiving body 102. In this manner, the front face 124 and the spaced apart fluid guide members 126 of the extension body 108 providing a means for channeling fluid into the fluid reservoir of the fluid-receiving-body. Preferably, but not necessarily, the front face 124 of the extension body is generally contiguous with an interior surface of the fluid reservoir 120.

The drain member 104 is attached to the fluid receiving body 102 is communicative with the fluid reservoir 120. Through such attachment and fluid communication, the drain member 104 enables fluid within the fluid reservoir 120 to pass through the drain member 104. Preferably, but not necessarily, a fluid passage 128 of the drain member 104 extends through the floor 122 of the fluid-receiving body 102, this allowing for all or nearly all of the contents of the fluid reservoir to drain through the passage of the drain member 104. In other embodiments (not specifically shown), the drain member may be attached to a sidewall of the fluid-receiving body 102 with the fluid passage extending though such sidewall. The drain member 104 includes a nipple portion 130 suitably configured for having a drain conduit 131 (FIG. 3) attached thereto for being in fluid communication with the fluid passage 128. The fluid conduit serves to direct fluid from within the fluid reservoir 120 to within a catch container or sewer drain. A hose or tube is an example of the conduit 131.

It is disclosed herein that the drain member 104 may be omitted from the fluid capture apparatus 100. In embodiments where the drain member 104 is omitted, the bottom end 118 will be a closed end. Removal of captured fluid will be accomplished manually (e.g., being poured out).

The support body 106 includes a first face 132 and a second face 134. The faces (132, 134) of the support body are preferably, but not necessarily, generally parallel to each other (i.e., generally flat opposed faces 132, 134). The support body 106 is configured for being attached to a support structure 136 (i.e., a table top) upon which a corresponding fluid dispensing container 138 (FIG. 3) rests.

It is disclosed herein that the support body 106 may be omitted with the extension body 108 suitably configured for being attached to a support surface (e.g., via a bracket). It is also disclosed herein that the support body 106 may be omitted with the extension body 108 suitably configured for being attached to a fluid-dispensing container (e.g., via a bracket).

As depicted, the front face 124 of the extension body 108 is preferably, but not necessarily, extends in a skewed relative to the faces (132, 134) of the support body 106. Accordingly, when the fluid-receiving body 102 is in a use orientation U (orientation depicted in FIG. 3), the support body 106 is vertically offset from the fluid receiving body 102 and is preferably, but not necessarily, horizontally offset from the fluid-receiving body 102. In other embodiments, not specifically shown, the front face 124 of the extension body 108 is at substantially a right angle with respect to the faces (132, 134) of the support body 106. The specific angular orientation of the front face 124 of the extension body 108 with respect to the faces (132, 134) of the support body 106 will depend on factors such as, for example, application requirements (i.e., space under flow control device 140 and horizontal offset of spigot from exterior face of container shell 142) and product designer preference. Examples of application requirements include, but are not limited to, space under a flow control device 140 of the fluid dispensing container 138 and horizontal offset of flow control device 140 relative to a container shell exterior face 142.

A skilled person will appreciate various extensions of the present invention. Examples of such extensions include, but are not limited to, an elongated fluid-receiving body that is positionable under a plurality of fluid control devices, making the fluid capture apparatus from any number of materials (e.g., plastic, stainless steel, ceramic, laminate, etc) and the fluid capture apparatus being any number of aesthetic configurations (e.g., color, texture, relative size, etc).

In use, the support body 106 of the fluid capture apparatus 100 is positioned on the support surface 136. The fluid-dispensing container 138 is positioned on the support body for securing the fluid capture apparatus in place relative to the fluid-dispensing container 138. The flow control device 140 of the fluid-dispensing container 138 is positioned over the front face 124 of the extension body 108 of the fluid capture apparatus 100. When spilled or dripped fluid is released from the flow control device 140, the fluid capture apparatus 100 captures it (e.g., falls onto the front face 124 of the extension body 108 and flows into the fluid reservoir 120). Depending on the specific configuration of the fluid capture apparatus 100, the fluid is either manually removed (e.g., poured from the fluid reservoir 120) or drains from the fluid reservoir 120 through the conduit 131 into a catch container or sewer drain.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice embodiments of the inventive disclosures made herein. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A fluid capture apparatus for capturing fluid from a fluid dispensing container being positioned on a support surface, the fluid dispensing container having a flow control device thereon, comprising:

a fluid-receiving body having an open end and a bottom end, wherein a fluid reservoir is defined between the open end and the bottom end;

an extension body having a first end thereof attached to the fluid-receiving body and a second end thereof, the extension body including a front face and spaced apart fluid guide members, the spaced apart fluid guide members protrude above the front face thereby providing means for channeling fluid into the fluid reservoir of the fluid-receiving body; and a support body, the support body being attached to the second end of the extension body wherein the extension body extends in a manner such that the support body is vertically offset from the fluid receiving body when the fluid-receiving body is in a use-orientation, the support body being substantially perpendicular to the extension body and being horizontally located upon the support surface in the use-orientation, the spaced apart fluid guide members extend at least partially between the support body and the fluid-receiving body, the support body not being removably connected to the fluid dispensing container when in use.

* * * * *